US010800629B2

(12) United States Patent
Grill

(10) Patent No.: US 10,800,629 B2
(45) Date of Patent: Oct. 13, 2020

(54) SHEET DEPOSITING ARRANGEMENT

(71) Applicant: BHS Corrugated Maschinen- und Anlagenbau GmbH, Weiherhammer (DE)

(72) Inventor: Martin Grill, Mantel (DE)

(73) Assignee: BHS Corrugated Maschinen- und Anlagenbau GmbH, Weiherhammer (DE)

( * ) Notice: Subject to any disclaimer, the term of this patent is extended or adjusted under 35 U.S.C. 154(b) by 1 day.

(21) Appl. No.: 15/833,252

(22) Filed: Dec. 6, 2017

(65) Prior Publication Data

US 2018/0155145 A1 Jun. 7, 2018

(30) Foreign Application Priority Data

Dec. 7, 2016 (DE) ..... 10 2016 224 408

(51) Int. Cl.
*B65H 29/18* (2006.01)
*B65H 29/54* (2006.01)
(Continued)

(52) U.S. Cl.
CPC ..... *B65H 29/22* (2013.01); *B65H 29/14* (2013.01); *B65H 29/16* (2013.01); *B65H 29/18* (2013.01); *B65H 29/50* (2013.01); *B65H 29/52* (2013.01); *B65H 29/54* (2013.01); *B65H 29/56* (2013.01); *B65H 31/10* (2013.01); *B65H 31/24* (2013.01); *B65H 31/26* (2013.01); *B65H 31/32* (2013.01);
(Continued)

(58) Field of Classification Search
CPC ..... B65H 29/18; B65H 29/16; B65H 29/54; B65H 29/56; B65H 2701/1762
See application file for complete search history.

(56) References Cited

U.S. PATENT DOCUMENTS 3,224,761 A * 12/1965 Meyer-Jagenberg ..... B65H 29/14 271/195
3,938,674 A 2/1976 Kroeze et al.
(Continued)

FOREIGN PATENT DOCUMENTS

CN 203127877 U 8/2013
CN 204078970 U 1/2015
(Continued)

*Primary Examiner* — Luis A Gonzalez
(74) *Attorney, Agent, or Firm* — McGlew and Tuttle, P.C.

(57) ABSTRACT

The invention relates to a sheet depositing arrangement. The sheet depositing arrangement comprises at least one sheet depositing apparatus having a sheet stacking chamber for creating a sheet stack, and a sheet extraction device which in turn has a sheet transporting means that is drivable in a direction of circulation, a sheet delivery region for delivering the sheets to be stacked to the sheet stacking chamber, a sheet stacking region, provided downstream of the sheet delivery region, for stacking the sheets to be stacked into the sheet stacking chamber, and a return region, provided downstream of the sheet stacking region. Furthermore, the sheet depositing apparatus has a sheet retaining device with at least one sheet retaining element, arranged adjacent to the sheet stacking region, for preventing at least one sheet to be stacked from being drawn into the sheet extraction device from the sheet stacking chamber by the sheet transporting means.

18 Claims, 6 Drawing Sheets

(51) Int. Cl.

| | |
|---|---|
| ***B65H 29/56*** | (2006.01) |
| ***B65H 29/22*** | (2006.01) |
| ***B65H 31/10*** | (2006.01) |
| ***B65H 29/50*** | (2006.01) |
| ***B65H 31/24*** | (2006.01) |
| ***B65H 29/14*** | (2006.01) |
| ***B65H 29/52*** | (2006.01) |
| ***B65H 29/16*** | (2006.01) |
| ***B65H 31/26*** | (2006.01) |
| ***B65H 31/32*** | (2006.01) |

(52) U.S. Cl.

CPC .. *B65H 2404/262* (2013.01); *B65H 2405/113* (2013.01); *B65H 2405/3311* (2013.01); *B65H 2701/1762* (2013.01); *B65H 2701/1764* (2013.01)

(56) References Cited

U.S. PATENT DOCUMENTS

| | | | | | |
|---|---|---|---|---|---|
| 4,285,511 | A * | 8/1981 | Abe | B65G 57/308 | 271/178 |
| 4,647,032 | A * | 3/1987 | Oba | B65H 29/048 | 271/186 |
| 5,116,303 | A | 5/1992 | Dietrich et al. | | |
| 5,295,680 | A * | 3/1994 | Nishiguchi | B65H 29/18 | 271/185 |
| 5,439,209 | A | 8/1995 | Rünzi | | |
| 5,472,185 | A * | 12/1995 | Kollann | B65H 29/58 | 198/367 |
| 6,311,973 | B1 | 11/2001 | Tanaka et al. | | |
| 6,446,962 | B1 | 9/2002 | Taffertshofer | | |
| 9,056,741 | B2 * | 6/2015 | Kang | B65H 29/52 | |
| 2004/0251587 | A1 | 12/2004 | Rilitz et al. | | |
| 2016/0052717 | A1 | 2/2016 | Wolf | | |
| 2018/0099833 | A1 * | 4/2018 | Talken | B65H 29/18 | |

FOREIGN PATENT DOCUMENTS

| | | | | | |
|---|---|---|---|---|---|
| CN | 105015040 | A | | 11/2015 | |
| CN | 105058871 | A | | 11/2015 | |
| DE | 39 29 508 | A1 | | 4/1990 | |
| DE | 93 04 964 | U1 | | 8/1994 | |
| DE | 60 2005 001 691 | T2 | | 4/2008 | |
| EP | 0 440 941 | A2 | | 8/1991 | |
| EP | 1 447 362 | A1 | | 8/2004 | |
| GB | 2017657 | A | * | 10/1979 | B65H 29/18 |
| GB | 1 558 367 | A | | 12/1979 | |
| GB | 2 224 010 | A | | 4/1990 | |
| JP | 2002-068653 | A | | 3/2002 | |
| JP | 2003182900 | A | * | 7/2003 | |

* cited by examiner

SHEET DEPOSITING ARRANGEMENT

CROSS-REFERENCE TO RELATED APPLICATIONS

This patent application claims priority of German Patent Application Serial No. DE 10 2016 224 408.6 filed on Dec. 7, 2016, pursuant to 35 U.S.C. 1.19 (a)-(d), the content of which is incorporated herein by reference in its entirety as if fully set forth herein.

FIELD OF THE INVENTION

The invention relates to a sheet depositing arrangement for depositing sheets, in particular corrugated-board sheets, in sheet stacks. Furthermore, the invention is directed at a sheet transporting means which is in particular part of such a sheet depositing arrangement. The invention is also directed at a plant, in particular a corrugated-board plant, having at least one such sheet depositing arrangement.

BACKGROUND OF THE INVENTION

Sheet depositing arrangements are well known from the prior art through public prior use. They serve to deposit or stack sheets in sheet stacks. A disadvantage of these sheet depositing arrangements is that, while the sheets are being stacked, faults sometimes occur which can result in at least one sheet or the sheet depositing arrangement being damaged. A stoppage of the entire plant can also be the result.

SUMMARY OF THE INVENTION

The invention is based on the object of creating a sheet depositing arrangement which is particularly unsusceptible to faults or is capable of operating in an extremely fault-free manner. A corresponding sheet transporting means and a corresponding plant are likewise intended to be provided.

This object is achieved according to the invention by a sheet depositing arrangement for depositing sheets in sheet stacks, the sheet depositing arrangement comprising at least one sheet depositing apparatus having a sheet stacking chamber for creating a sheet stack from the sheets, a sheet extraction device which has a sheet transporting means that is drivable in a direction of circulation, a sheet delivery region for delivering the sheets to be stacked to the sheet stacking chamber by way of the sheet transporting means, a sheet stacking region, provided downstream of the sheet delivery region with regard to the direction of circulation, for stacking the sheets to be stacked into the sheet stacking chamber, with the sheet stack being formed, by way of the sheet transporting means, wherein the sheet transporting means extends in a straight line at least regionally directly adjacent to the sheet stacking chamber in the sheet stacking region, and a return region, provided downstream of the sheet stacking region with regard to the direction of circulation, for the sheet transporting means, and having a sheet retaining device with at least one sheet retaining element, arranged adjacent to the sheet stacking region, for preventing at least one sheet to be stacked from being drawn into the sheet extraction device from the sheet stacking chamber by the sheet transporting means. This object is further achieved by a sheet transporting means, in particular as part of a sheet depositing arrangement according to the invention, the sheet transporting means having at least one outwardly open receiving recess for at least partially receiving at least one sheet retaining element. Finally, this object is achieved by a plant, in particular a corrugated-board plant, comprising an arrangement for producing a material web, at least one crosscutting device, associated to the material web, for creating sheets from the material web, and at least one sheet depositing arrangement, arranged downstream of the at least one crosscutting device, according to the invention. The essence of the invention resides in a sheet retaining device which is capable of reliably preventing at least one sheet to be stacked or deposited from being drawn in an undesired manner into the sheet extraction device from the adjacent sheet stacking chamber by the driven sheet transporting means during stacking, this having occurred repeatedly in generic sheet depositing arrangements. Faults during the stacking of the sheets are thus effectively and easily avoidable. Furthermore, damage to the sheet depositing arrangement is reliably preventable.

During stacking, the sheet transporting means favourably moves relative to the sheet retaining device. The sheet retaining device is preferably held or arranged in a stationary manner in the sheet depositing arrangement. The sheets to be stacked likewise favourably move relative to the sheet retaining device during stacking. The sheet retaining device is preferably embodied as a guiding device and/or blocking device for the sheets to be stacked.

It is advantageous for the sheet extraction device to comprise a drive unit for driving the sheet transporting means. The drive unit is formed for example by at least one drive, in particular an electric drive.

It is advantageous for the sheet transporting means to be closed in the direction of circulation, or circumferentially. The sheet transporting means is preferably endless. It is expedient for the sheet transporting means to be flexible. The sheet transporting means is formed for example by at least one endless sheet transporting element.

Favourably, in the sheet delivery region, the sheet transporting means extends horizontally or downwardly in a manner inclined slightly with respect to a horizontal in the direction of the sheet stacking chamber. There, the sheet transporting means transports the sheets to be stacked preferably in a corresponding delivery direction to the sheet stacking chamber, or in the direction thereof, during operation.

The sheet stacking region favourably directly adjoins the sheet delivery region. With respect to the sheet delivery region, it extends preferably in an inclined manner. It is advantageous for the sheet transporting means to extend at least regionally in a vertical straight line or downwardly in a manner inclined slightly with respect to a vertical in the sheet stacking region. The sheet transporting means preferably at least regionally encloses, in the sheet stacking region, an angle of between 0° and 20°, more preferably between 1° and 8°, more preferably between 1° and 5°, with respect to a vertical. There, during the stacking of the sheets, the sheet transporting means transports the sheets to be stacked preferably in a corresponding stacking direction. It deposits the sheets to be stacked in particular in a targeted or guided manner. In particular, the stacking direction is directed downwardly in the sheet stacking region. It is advantageous for the sheets to rest at least regionally on the sheet transporting means, to the side of the at least one sheet retaining element, in the sheet stacking region.

The return region, in which the sheet transporting means runs back to the sheet delivery region, favourably extends in an inclined manner with respect to the sheet stacking region. It is advantageous for the sheet transporting means, in the return region, to move at least regionally in the opposite direction to the sheet transporting means in the sheet delivery region during operation.

It is advantageous for the sheet stacking chamber to be spatially bounded downwardly by a stacking base. The stacking base is preferably planar and extends preferably horizontally. Preferably, the stacking base is adjustable in height.

It is advantageous for the sheets in the sheet stack to be arranged in a congruent manner one on top of another.

The arrangement for producing a material web is favourably capable of producing an endless material web. It is expedient for the material web to be a multiply web. The material web is in particular a three-ply, five-ply or seven-ply web. It is embodied in particular as a multiply corrugated-board web.

The configuration of the sheet depositing arrangement according t which the at least one sheet retaining element is arranged at least regional y upstream of the return region with regard to the direction of circulation results in a sheet depositing arrangement that is particularly reliable or unsusceptible to faults. It is thus possible to effectively prevent the sheet extraction device or the sheet transporting means from drawing in or, respectively, grasping again, even only partially, a sheet already located in the sheet stacking chamber during the stacking of the sheets.

The statements given above apply in a substantially analogous manner to a sheet depositing arrangement comprising a return gap, bounded by the sheet transporting means in the return region, the at least one sheet retaining element reaching over said return gap at least regionally upstream with regard to the direction of circulation in order to prevent at least one sheet to be stacked from being drawn into the sheet extraction device from the sheet stacking chamber by the sheet transporting means. The at least one sheet retaining element reaches preferably completely over the return gap. It is arranged at least regionally on the input side with regard to the return gap.

The statements given above also apply substantially to a configuration of sheet depositing arrangement according to which the at least one sheet retaining element extends at least regionally along the sheet stacking region.

According to a preferred embodiment, the at least one sheet retaining element engages at least partially in the sheet transporting means. It is expedient for the at least one sheet retaining element in the process to engage in the sheet transporting means from the outside or an outer side of the latter. Alternatively, the sheet transporting means is formed by at least two, favourably identical, sheet transporting elements, wherein at least one sheet retaining element is then arranged preferably between two adjacent sheet transporting elements.

The at least one receiving recess of the sheet transporting means for at least partially receiving the at least one sheet retaining element is favourably closed or endless in the direction of circulation of the sheet transporting means. It is advantageous for the at least one receiving recess to have a width, perpendicularly to the direction of circulation of the sheet transporting means, which corresponds approximately to the width of the at least one sheet retaining element perpendicularly to the direction of circulation of the sheet transporting means. The width of the at least one receiving recess is favourably constant. It is preferably between 20 mm and 200 mm, more preferably between 30 mm and 60 mm. It is advantageous for the at least one receiving recess to have a depth of between 1 mm and 15 mm, preferably between 3 mm and 10 mm.

In the sheet stacking region, the at least one receiving recess preferably faces or is open towards the adjacent sheet stacking chamber. It is advantageous for the at least one sheet retaining element to engage at least regionally, preferably completely, in particular on the head side, in the sheet transporting means there. Favourably, the at least one sheet retaining element protrudes, at least on the head side, at most a little with respect to the sheet transporting means perpendicularly to the outer side thereof or in the direction of the sheet stacking chamber.

Preferably, the at least one sheet retaining element is embodied in a bar-like manner. Such a sheet retaining element is producible extremely cost-effectively. It preferably extends in a vertical direction.

The at least one sheet retaining element, which encloses an angle of between 0° and 10° with respect to a vertical, results in a particularly congruent arrangement of the sheets to be stacked on top of one another in the sheet stack. The at least one sheet retaining element to this end preferably has an orienting or sliding face, facing the adjacent sheet stacking chamber, along which the sheets to be stacked slide downwardly at least regionally in the sheet stacking chamber during stacking.

The at least one head end of the at least one sheet retaining element has at least one free head end which faces upstream with regard to the direction of circulation and is arranged, in particular directly, adjacent to the sheet stacking region, wherein, preferably, the at least one sheet retaining element narrows towards the at least one free head, end is favourably formed by a horizontally extending head edge. It is preferably directed upwardly, or in the direction of the sheet delivery region.

The at least one sheet retaining element that narrows towards the at least one free head end in particular allows the sheets to be stacked in the sheet stacking chamber to be guided in the direction of the stacking base, or downwardly, in a particularly reliable or fault-free manner.

The sheet retaining device favourably has at least one support member which supports the at least one sheet retaining element. The at least one support member extends preferably horizontally. It is advantageous for the at least one support member to be arranged beneath the sheet transporting means. It is expedient for the at least one sheet retaining element to project upwardly from the at least one support member.

The configuration of the sheet depositing arrangement comprising a multiplicity of sheet retaining elements allows again sheets to be stacked in a manner particularly unsusceptible to faults. Preferably, at least three, more preferably at least five, more preferably at least ten, sheet retaining elements are provided. The sheet retaining elements are preferably configured identically.

Favourably, the sheet retaining elements are arranged alongside one another in a spaced-apart manner, in particular equidistantly, perpendicularly to the direction of circulation of the sheet transporting means. The spacing between two sheet retaining elements that are arranged adjacent to one another is preferably at least 50 mm, more preferably at least 115 mm. The sheet retaining elements are preferably arranged in a finger-like manner. The sheet retaining device is preferably configured in a comb-like manner.

The sheet transporting means embodied as a one-piece be s preferably endless and flexible. It is preferably profiled.

It is advantageous, in a sheet depositing arrangement where the sheet stacking region is bounded by at least two deflection rollers for guiding the sheet transporting means, wherein, in particular, at least the upstream one of these deflection rollers with regard to the direction of circulation is arranged directly adjacent to the sheet stacking chamber, for the deflection rollers for forming the sheet stacking region to have a small diameter, in particular a smaller diameter than the other rollers of the sheet extraction device. Favourably, the upstream one of these deflection rollers, with regard to the direction of circulation, has a diameter of between 1 cm and 20 cm, more preferably between 2 cm and 7 cm, in order to form a knife edge. Said upstream roller favourably forms a knife-edge deflection roller. The other of these deflection rollers preferably has a diameter of between 5 cm and 30 cm, more preferably between 6 cm and 10 cm. This roller favourably forms a knife-edge deflection roller. The sheets are thus able to be guided in the sheet stacking region for a particularly long time.

Favourably, the sheet transporting means extends in the sheet stacking region as far as the sheet stacking chamber, or as far as a stack edge. Favourably, there is a maximum spacing of 15 mm between the sheet stacking region and the sheet stacking chamber, in particular between the upstream deflection roller of the sheet stacking region and the sheet stacking chamber.

The sub-claims also relate to preferred developments of the plant, particular the corrugated-board plant, according to the invention. The sheet depositing arrangement comprising a sheet transporting means having at least one outwardly open receiving recess for at least partially receiving the at least one sheet retaining element also relates to an advantageous development of the sheet transporting means according to the invention.

A preferred embodiment of the invention is described by way of example in the following text with reference to the accompanying drawing.

DESCRIPTION OF THE PREFERRED EMBODIMENT

Figure 1:
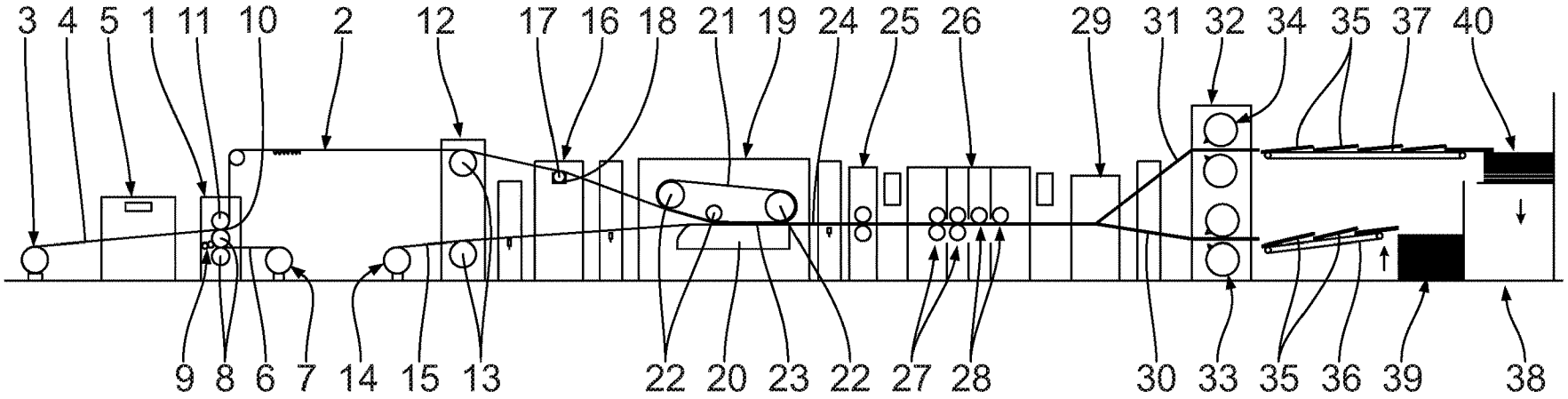
FIG. 1 shows a side view of a highly simplified corrugated-board plant according to the invention with a sheet depositing arrangement.

With reference first of all to FIG. 1, a corrugated-board plant illustrated therein comprises a machine 1 for producing a corrugated-board web 2 laminated on one side.

A first unrolling device 3 feeds a first, preferably endless, material web 4 via a preheating device 5 to the machine 1 for producing the corrugated-board web 2 that is laminated on one side. The first material web 4 represents a top web for the corrugated-board web 2 laminated on one side that is produced in the machine 1 for producing the corrugated-board web 2 laminated on one side.

The first material web 4 is combined, in the machine 1 for producing the corrugated-board web 2 laminated on one side, with a second, preferably endless, material web 6 which is unrolled from a second unrolling device 7.

In the machine 1 for producing the corrugated-board web 2 laminated on one side, the second material web 6 is guided through between two fluted rollers 8, arranged adjacent to one another, in order to produce a corrugation or fluting. The second material web 6 is thus in the form of a corrugated web after being passed through a fluting gap of the fluted rollers 8, and has alternately corrugation peaks and corrugation troughs.

Subsequently, the corrugated web 6 is glued by a gluing device 9 in the machine 1 for producing the corrugated-board web 2 laminated on one side the glue application roller of said gluing device 9 forming a gluing gap with the upper fluted roller 8.

The glued corrugated web 6 is subsequently compressed in a pressing gap 10 with the first material web 4 in the machine 1 for producing the corrugated-board web 2 laminated on one side, said pressing gap 10 being formed between the upper fluted roller 8 and a pressing device 11 arranged ire the machine 1 for producing the corrugated-board web 2 laminated on one side. In this way, the first material web 4 and the corrugated web 6 are connected together by gluing, forming the, in particular endless, corrugated-board web 2 laminated on one side.

Arranged downstream of the machine 1 for producing the corrugated-board web 2 laminated on one side is a preheating arrangement 12 having two heatable heating rollers 13 arranged one above the other.

Arranged upstream of the preheating arrangement 12 is a third unrolling device 14 for a third, preferably endless, material web 15. The third material web 15 forms a laminating web.

The corrugated-board web 2 laminated on one side and the third material web 15 are transported through the preheating arrangement 12. In the preheating arrangement 12, they both partially wrap around a heating roller 13 and are heated in the process.

Downstream of the preheating arrangement 12, the corrugated-board plant has a gluing unit 16 with a gluing roller 17 which is dipped partially into a glue bath 18. The corrugated-board web 2 laminated on one side is in direct contact with the gluing roller 17 by way of its corrugated web 6, such that the corrugation peaks thereof are glued there.

Downstream of the gluing unit 16, the corrugated-board plant has a heating and pressing apparatus 19 which comprises a horizontal table 20 with heating plates (not illustrated). Above the table 20, the heating and pressing apparatus 19 has an endless pressing belt 21, which is guided and driven about rollers 22. Formed between the pressing belt 21 and the table 20 is a pressing gap 23 through which the corrugated-board web 2 laminated on one side and the third material web 15 are guided and are joined together by gluing, forming a three-ply, in particular endless, corrugated-board web 24.

Downstream of the heating and pressing apparatus 19, the corrugated-board plant preferably has a short crosscutting apparatus 25, which serves for the one part for safely removing delivery waste and for the other part for carrying out order changes and format changes.

The corrugated-board plant furthermore comprises a longitudinal cutting and grooving apparatus 26 which is arranged downstream of the short crosscutting apparatus 25, if present, and comprises two grooving stations 27 arranged one after another, and two longitudinal cutting stations 28, arranged one after another.

Downstream of the longitudinal cutting and grooving apparatus 26, the corrugated-board plant comprises a diverter 29 in which longitudinally cut, in particular endless, sub-webs 30, 31 from the three-ply corrugated-board web 24 are separated spatially from one another.

The sub-webs 30, 31 are subsequently fed to a crosscutting device 32 arranged downstream of the diverter 29. The crosscutting device 32 has a first, or lower, crosscutting roller pair 33 for transversely severing the first, or lower, sub-web 30. Furthermore, the crosscutting device 32 comprises a second, or upper, crosscutting roller pair 34 for transversely severing the second, or upper, sub-web 31. Each crosscutting roller pair 33, 34 has two rotationally driven rollers with a radially outwardly extending crosscutting blade. The crosscutting blades of a crosscutting roller pair 33, 34 cooperate in a cutting manner for transversely severing the respective sub-web 30 or 31, with the result that corrugated-board sheets 35 are produced from the sub-web 30 or 31.

In order to correspondingly actuate the crosscutting device 32, register-mark sensors can be arranged in the corrugated-board plant, which detect register marks on the corrugated-board web 2 laminated on one side, or on the three-ply corrugated-board web 24.

The corrugated-board sheets 35 produced from the first sub-web 30 are fed to a sheet depositing arrangement 38 in an imbricated manner via a first, or lower, conveyor belt 36 and the corrugated-board sheets 35 produced from the second sub-web 31 are fed thereto in an imbricated manner via a second, or upper, conveyor belt 37. The lower conveyor belt 36 is thus associated to the lower crosscutting roller pair 33, while the upper conveyor belt 37 is associated to the upper crosscutting roller pair 34. The lower conveyor belt 36 conveys the corrugated-board sheets 35 produced by the lower crosscutting roller pair 33 to a first sheet depositing apparatus 39 of the sheet depositing arrangement 38, while the upper conveyor belt 37 conveys the corrugated-board sheets 35 produced by the upper crosscutting roller pair 34 to a second sheet depositing apparatus 40 of the sheet depositing arrangement 38.

The first sheet depositing apparatus 39 and the second sheet depositing apparatus 40 are embodied identically. They are illustrated only by way of example in FIG. 1. Therefore, for the sake of brevity, only the first sheet depositing apparatus 39 is described in detail in the following text, in particular with reference to FIGS. 2 to 6.

The first sheet depositing apparatus 39 has a framework 42 that is supported with respect to a base 41 and which in turn comprises two mutually opposite side members 43, 44. A cross member 45 of the framework 42 extends at the top between these side members 43, 44.

The first sheet depositing apparatus 39 also has a stacking base 46 which is arranged between the side members 43, 44 thereof and extends horizontally. The stacking base 46 is adjustable in height. To this end, the first sheet depositing apparatus 39 has a corresponding height-adjustment device (not illustrated).

By way of the stacking base 46 and the side members 43, 44, a sheet stacking chamber 47 of the first sheet depositing apparatus 39 is spatially delimited.

The first sheet depositing apparatus 39 furthermore has a sheet extraction device 48, which is favourably arranged on the framework 42 thereof. The sheet extraction device 48 has an endless one-piece belt 49 which is guided in a direction of circulation 50 during operation.

The sheet extraction device 48 comprises a first deflection roller 51, which is arranged adjacent to a downstream discharging region of the lower conveyor belt 36. It furthermore has a second deflection roller 52, which is arranged immediately adjacent to the sheet stacking chamber 47 approximately at the vertical height of the first deflection roller 51 and has a very small diameter. The sheet extraction device 48 furthermore comprises a third deflection roller 53, which is arranged immediately adjacent to the sheet stacking chamber 47 beneath the second deflection roller 52. The third deflection roller 53 is set back slightly in the direction of the first deflection roller 51 with respect to the second deflection roller 52, preferably by between 1 mm and 10 mm, more preferably between 2 mm and 6 mm. Furthermore, the first sheet extraction device 48 has a tension roller 54 for tensioning the belt 49 and a fourth deflection roller 55, Which are arranged between the third deflection roller 53 and the first 115 deflection roller 51.

The first deflection roller 51, the second deflection roller 52, the third deflection roller 53 and the tension roller 54, and also the fourth deflection roller 55 are rotatably mounted on two mutually opposite frame walls 56 of the sheet extraction device 48, which are in turn fastened to the framework 42. Their axes of rotation extend parallel to one another and perpendicularly to the direction of circulation 50 of the belt 49.

With regard to the direction of circulation 50, the first deflection roller 51 is arranged downstream of the second deflection roller 52, which is in turn arranged downstream of the third deflection roller 53 with regard to the direction of circulation 50. The third deflection roller 53 is arranged downstream of the tension roller 54 with regard to the direction of circulation 50, said tension roller 54 in turn being arranged downstream of the fourth deflection roller 55 with regard to the direction of circulation 50. The belt 49 is guided about the first deflection roller 51, the second deflection roller 52, the third deflection roller 53, the tension roller 54 and the fourth deflection roller 55 and bears regionally against the circumferences thereof.

Figure 6:
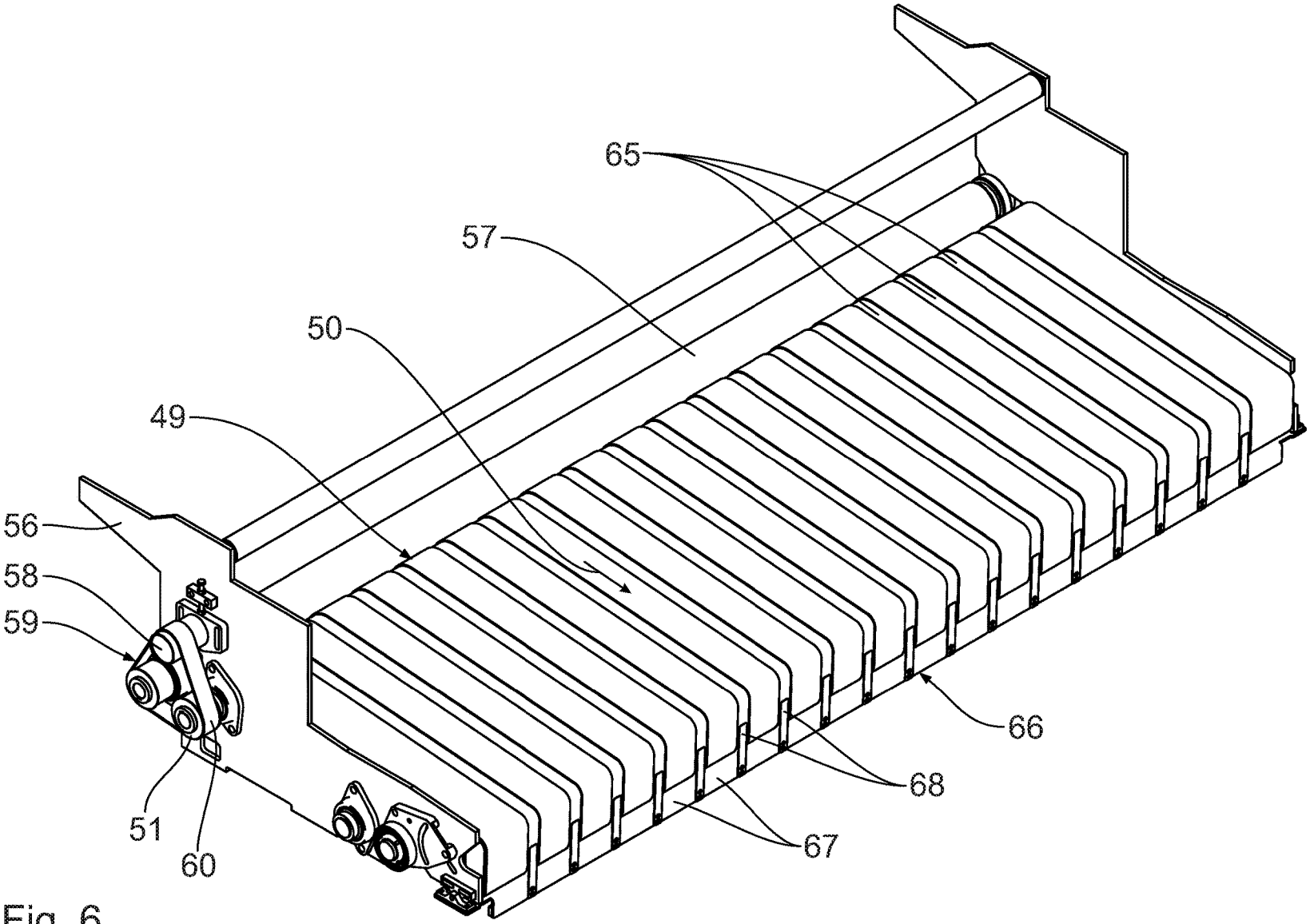
FIG. 6 shows a perspective view which illustrates the sheet depositing arrangement shown in FIGS. 2 to 4.

Furthermore, the sheet extraction device 48 has a coupling roller 57 which extends between the frame walls 56 and is mounted in a rotatable manner thereon (FIG. 6). The coupling roller 57 likewise extends perpendicularly to the direction of circulation 50 of the belt 49.

The sheet extraction device 48 also comprises a drive shaft 58 which is a component part of a drive 59 and is able to be driven in rotation (FIG. 6). An endless drive belt 60 is guided about the drive shaft 58, the first deflection roller 51 and the coupling roller 57 outside a frame wall 56. The axis of rotation of the drive shaft 58 extends parallel to the axis of rotation of the first deflection roller 51. Upon actuation of the drive 59, the drive shaft 58 thereof is set in rotation, this in turn resulting in the first deflection roller 51 and the coupling roller 57 being driven in rotation on account of the coupling via the drive belt 60. By way of the coupling roller 57, the first deflection roller 51 is able to be driven on both sides. The belt 49 is thus continuously driveable in the direction of circulation 50.

The sheet extraction device 48 has a sheet delivery region 61, which is present between the first deflection roller 51 and the second deflection roller 52. The sheet delivery region 61 thus extends between the lower conveyor belt 36 and the sheet stacking chamber 47. It immediately adjoins the lower conveyor belt 36. In the sheet delivery region 61, the belt 49 extends in a straight line and slightly downwards from the lower conveyor belt 36 to the sheet stacking chamber 47. The sheet delivery region 61 ends at the second deflection roller 52.

Downstream of the sheet delivery region 61, with respect to the direction of circulation 50, the sheet extraction device 48 has a sheet stacking region 69 which is present between the second deflection roller 52 and the third deflection roller 53. The sheet stacking region 69 extends along the sheet stacking chamber 47, immediately adjacently thereto. In the sheet stacking region 69, the belt 49 extends straight down from the second deflection roller 52. The belt 49 encloses an angle w of between 1° and 8° with respect to a vertical V there. It extends in a straight line in the sheet stacking region 69 along a length l of between 6 cm and 40 cm, more preferably between 8 cm and 15 cm.

Downstream of the sheet stacking region 69 with respect to the direction of circulation 50, the sheet extraction device 48 has a return region 62. The return region 62 extends between the third deflection roller 53 and the first deflection roller 51. Located in the return region 62 are the tension roller 54 and the fourth deflection roller 55. In the return region 62, the belt 49 extends back from the third deflection roller 53 to the first deflection roller 51. There, the belt 49 extends at least regionally opposite the belt 49 in the sheet delivery region 61.

The belt 49 has an outer side 63 that faces outwards and an inner side 64 located on the opposite side therefrom. A plurality of endless receiving recesses 65 of the belt 49 extend from the outer side 63, said receiving recesses 65 extending parallel to one another and being arranged in a manner distributed equidistantly in a width direction, extending perpendicularly to the direction of circulation 50, of the belt 49. The receiving recesses 65 are configured identically. They extend in the direction of circulation 50 of the belt 49. The receiving recesses 65 are delimited in the width direction by mutually opposite flanks of the belt 49. They have a constant width or breadth. In the region of the receiving recesses 65, the belt 49 thus has in each case a reduced, constant thickness.

Furthermore, the first sheet depositing apparatus 39 has a sheet retaining device 66. The sheet retaining device 66 comprises a cross member 67 which extends over the entire width of the belt 49 and perpendicularly to the direction of circulation 50 of the belt 49. The cross member 67 is arranged on the frame walls 56, or on the framework 42. It extends beneath the third deflection roller 53 and adjacent to the latter. The cross member 67 extends horizontally.

A multiplicity of sheet retaining elements 68 of the sheet retaining device 66 project upwardly, or vertically, in a finger-like manner from the cross member 67. The sheet retaining elements 68 are embodied in a bar-like manner and extend at the bottom along the sheet stacking region 69. They extend parallel to one another.

Each sheet retaining element 68 has an upper free head end 70 which is formed by a horizontally extending head edge of the respective sheet retaining element 68 and is received entirely in the adjacent receiving recess 65 in the sheet stacking region 69.

Above the sheet region 61, the first sheet depositing apparatus 39 has a pressure roller 71. The pressure roller 71 extends horizontally and is mounted in a freely rotatable manner in a pivotable arm arrangement 72. It extends adjacent to and parallel to the second deflection roller 52.

During operation of the corrugated-board plant, the corrugated-board sheets 35 that are produced are transferred from the lower conveyor belt 36 onto the heft 49, which is driven continuously in the direction of circulation 50. A corrugated-board sheet 35 to be stacked is thus transported from the belt 49 in the direction of the sheet stacking chamber 47 in the sheet delivery region 61. It arrives, immediately upstream of the sheet stacking chamber 47, in a feed gap 73 which is formed by the pressure roller 71 and the belt 49 at the second deflection roller 52. The pressure roller 71 in this case bears on the corrugated-board sheet 35 with its own weight.

Figure 2:
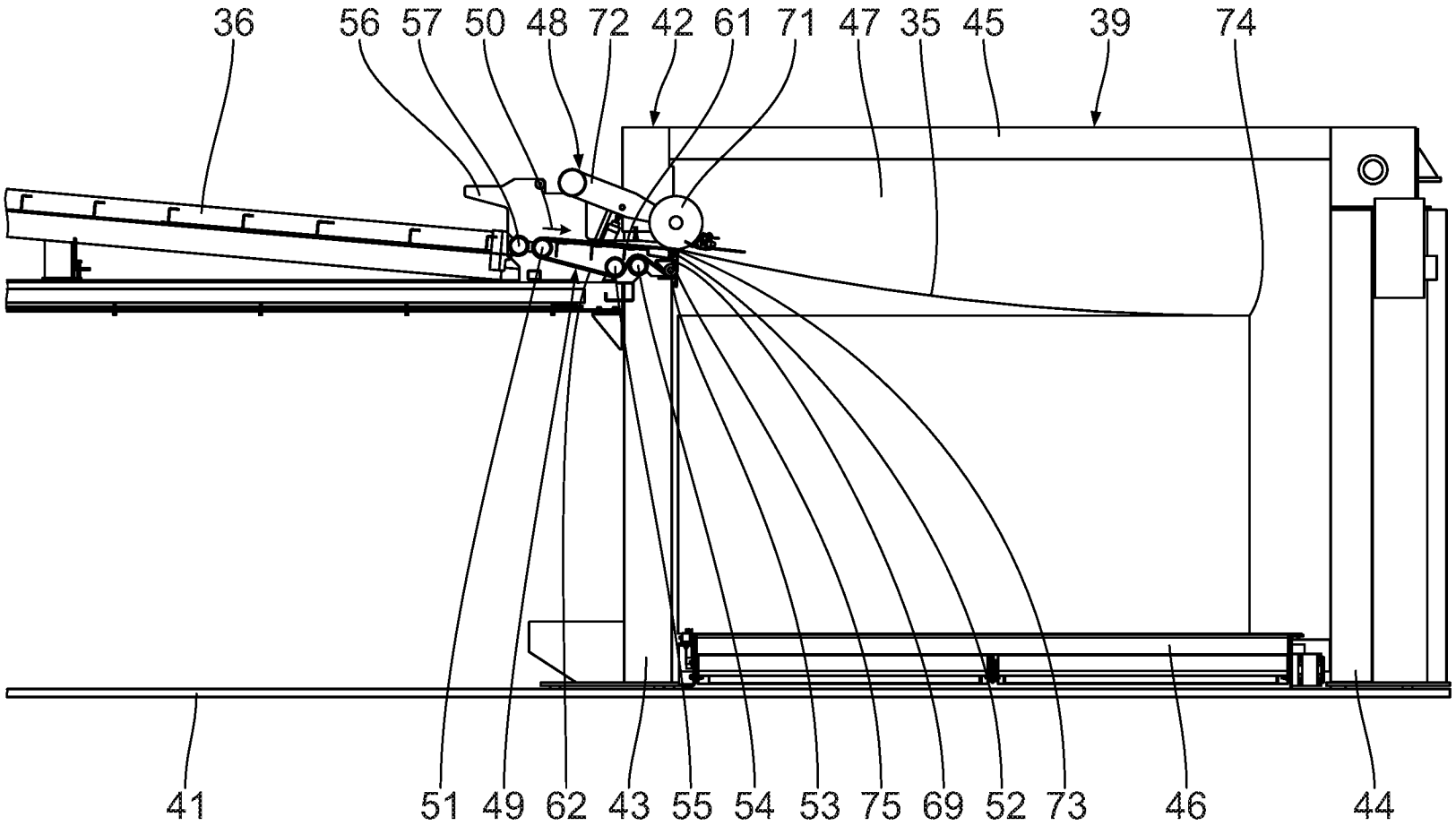
FIGS. 2 to 4 show side views of a sheet depositing arrangement according to the invention of the corrugated-board plant illustrated in FIG. 1, said figures illustrating the operation of depositing a sheet.

As FIG. 2 shows, the corrugated-board sheet 35 to be stacked then passes with its leading end 74 into the sheet stacking chamber 47. The leading end 74 is pushed away from the feed gap 73 onto a corrugated-board sheet 35 already deposited properly, or the stacking base 46, in the sheet stacking chamber 47 by the belt 49. The leading end 74 of the corrugated-board sheet 35 thus leaves the belt 49 after the feed gap 73. A trailing end 75 of this corrugated-board sheet 35 initially continues to rest on the belt 49 in the sheet stacking region 69.

Figure 3:
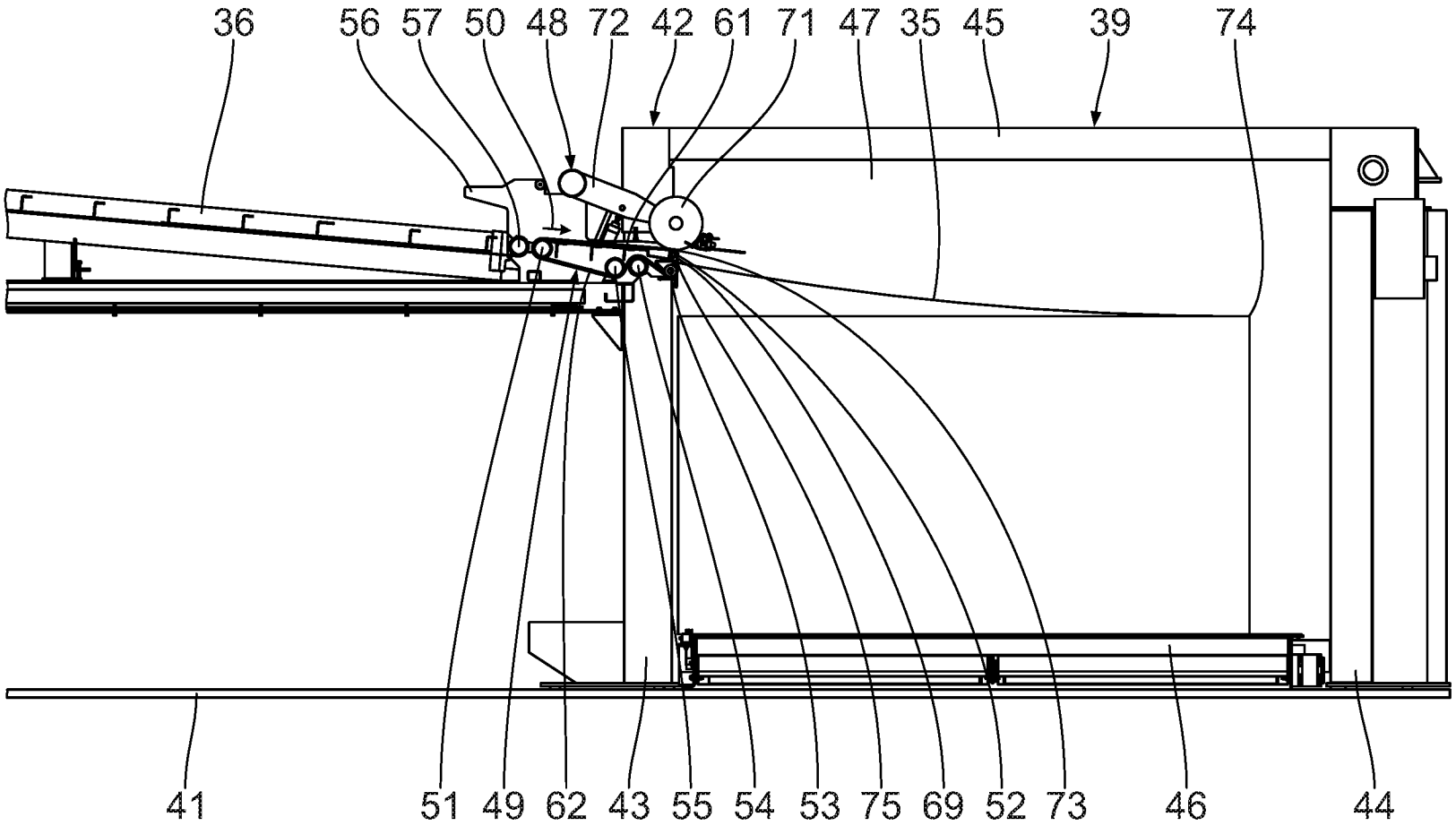

The trailing end 75 of the corrugated-board sheet 35 remains in contact with the belt 49 even after passing through the feed gap 73. It passes into the sheet stacking region 69 and is thus guided downwardly in a targeted manner onto the sheet 35 already deposited properly, or the stacking base 46, by the belt 49 extending downwardly there (FIG. 3).

Figure 4:
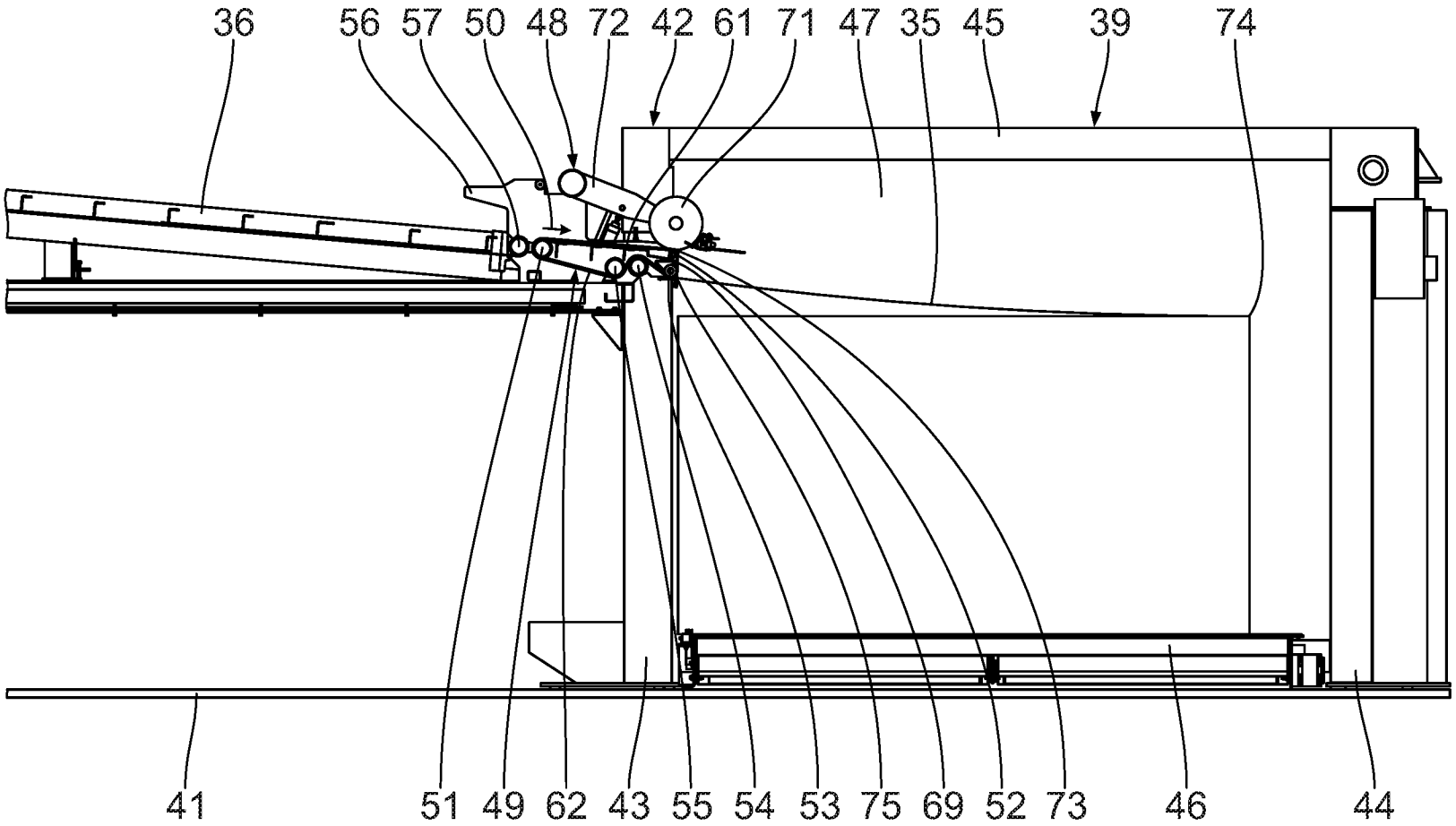
Figure 5:
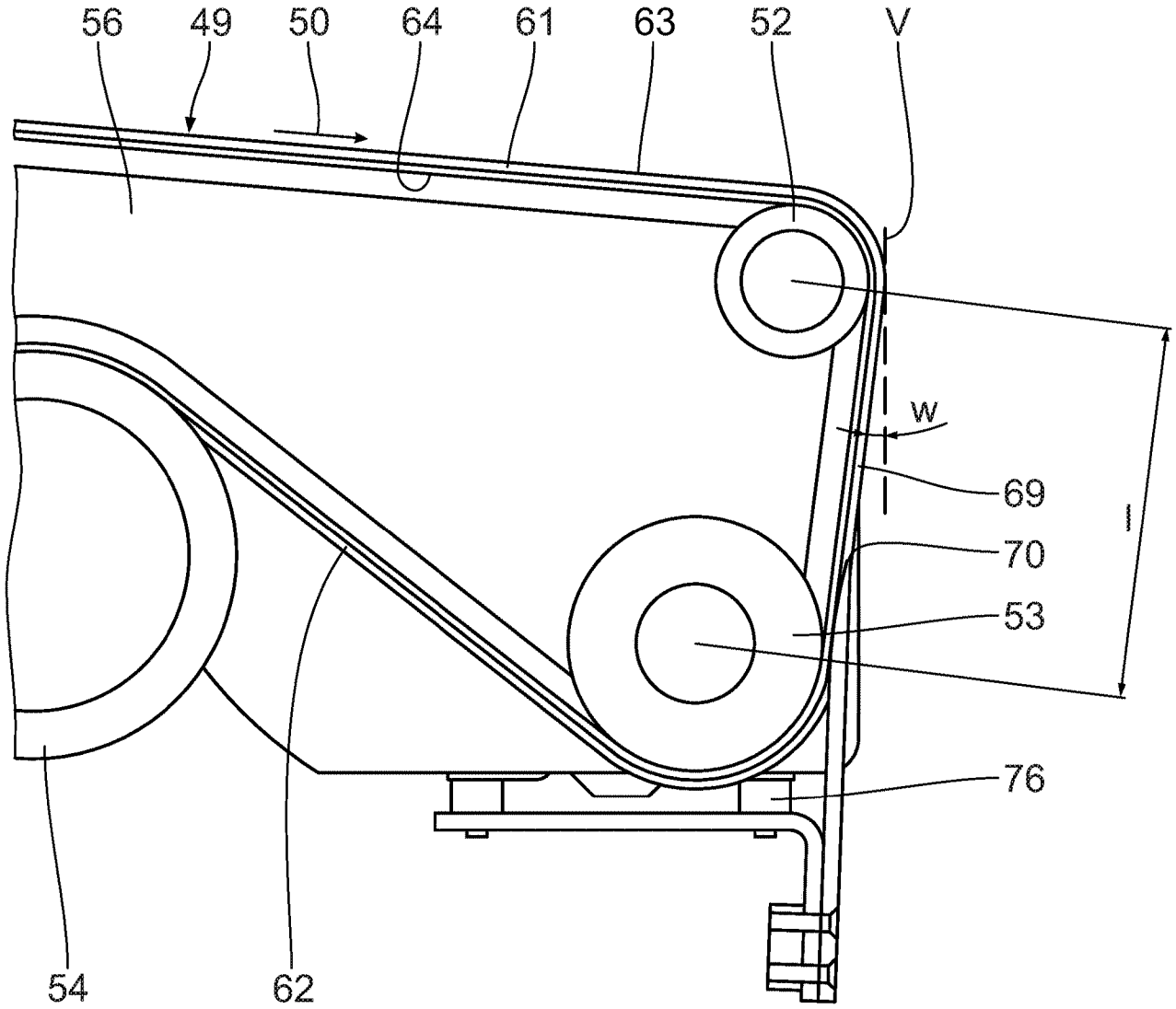
FIG. 5 shows an enlarged side view which illustrates a downstream end region of the sheet depositing arrangement illustrated in FIGS. 2 to 4.

In the sheet stacking region 69, the trailing end 75 of the corrugated-board sheet 35 first of all reaches the head ends 70 of the sheet retaining elements 68. The trailing end 75 of the corrugated-board sheet 35 slides downwardly along the sheet retaining elements 68 in a manner guided outwards, said sheet retaining elements 68 thus continuing to guide the corrugated-board sheet 35 downwards (FIG. 4). In the process, a relative movement occurs between the corrugated-board sheet 35 and the sheet retaining elements 68. The trailing end 75 of the corrugated-board sheet 35 preferably continues to rest at least regionally on the belt 49 in the sheet stacking region 69 between the sheet retaining elements 68.

Once a return gap 76 delimited by the belt 49 has been passed over on the outside by the sheet retaining elements 68 on the inlet side of the return region 62 of the belt 49 with respect to the direction of circulation 50, it is not possible for the corrugated-board sheet 35 to be drawn in there along the return region 62 from the sheet stacking chamber 47 by the belt 49.

The second sheet depositing apparatus 40 operates analogously.

During stacking, the stacking base 46 is gradually lowered.

What is claimed is:

1. A sheet depositing arrangement for depositing sheets in sheet stacks, the sheet depositing arrangement comprising:

at least one sheet depositing apparatus comprising:

a sheet stacking chamber for creating a sheet stack from the sheets;

a sheet extraction device having a sheet transporting means that is drivable in a direction of circulation, a sheet delivery region for delivering the sheets to be stacked to the sheet stacking chamber by way of the sheet transporting means, a sheet stacking region, provided downstream of the sheet delivery region with regard to the direction of circulation, for stacking the sheets to be stacked into the sheet stacking chamber, with the sheet stack being formed, by way of the sheet transporting means, wherein the sheet transporting means extends in a straight line at least regionally directly adjacent to the sheet stacking chamber in the sheet stacking region, and the sheet extraction device further comprising a return region, provided downstream of the sheet stacking region with regard to the direction of circulation, for the sheet transporting means; and a sheet retaining device with at least one sheet retaining element, arranged adjacent to the sheet stacking region, for preventing at least one sheet to be stacked from being drawn into the sheet extraction device from the sheet stacking chamber by the sheet transporting means, the sheet transporting means having at least one outwardly open receiving recess for at least partially receiving the at least one sheet retaining element, wherein the at least one sheet retaining element extends at least regionally along the sheet stacking region, the at least one retaining element comprising an orienting or sliding face facing the sheet stacking chamber, wherein the sheets to be stacked slide along the orienting or sliding face downwardly at least regionally in the sheet stacking chamber during stacking.

2. The sheet depositing arrangement according to claim 1, wherein the at least one sheet retaining element is arranged at least regionally upstream of the return region with regard to the direction of circulation.

3. The sheet depositing arrangement according to claim 1, further comprising a return gap, bounded by the sheet transporting means in the return region, the at least one sheet retaining element reaching over said return gap at least regionally upstream with regard to the direction of circulation in order to prevent at least one sheet to be stacked from being drawn into the sheet extraction device from the sheet stacking chamber by the sheet transporting means, the sheet stacking region being located on one side of the at least one sheet retaining element.

4. The sheet depositing arrangement according to claim 1, wherein the at least one sheet retaining element engages at least partially into the sheet transporting means.

5. The sheet depositing arrangement according to claim 1, wherein the at least one sheet retaining element encloses an angle of between 0° and 10° with respect to a vertical.

6. The sheet depositing arrangement according to claim 1, wherein the at least one sheet retaining element has at least one free head end which faces upstream with regard to the direction of circulation and is arranged adjacent to the sheet stacking region.

7. The sheet depositing arrangement according to claim 6, wherein the at least one free head end is arranged directly adjacent to the sheet stacking region.

8. The sheet depositing arrangement according to claim 6, wherein the at least one sheet retaining element narrows towards the at least one free head end.

9. The sheet depositing arrangement according to claim 6, wherein the at least one free head end is spaced from at least one of the group comprising the sheet delivery region and the return region.

10. The sheet depositing arrangement according to claim 1, wherein the at least one sheet depositing apparatus further comprises another sheet retaining device to provide a multiplicity of sheet retaining elements, at least a portion of the at least one sheet retaining element being located adjacent to the sheet stacking region.

11. The sheet depositing arrangement according to claim 1, wherein the sheet transporting means is embodied as a one-piece belt.

12. The sheet depositing arrangement according to claim 1, wherein the sheet stacking region is bounded by at least two deflection rollers for guiding the sheet transporting means.

13. The sheet depositing arrangement according to claim 12, wherein an upstream roller of the at least two deflection rollers with regard to the direction of circulation is arranged directly adjacent to the sheet stacking chamber.

14. The sheet depositing arrangement according to claim 1, wherein the sheet transporting means in the sheet stacking region extends in a straight line at least regionally directly adjacent to the sheet stacking chamber and encloses an angle of between 0° and 20° with respect to a vertical.

15. The sheet depositing arrangement according to claim 14, wherein the sheet transporting means in the sheet stacking region encloses an angle of between 1° and 8° with respect to a vertical.

16. The sheet depositing arrangement according to claim 1, wherein deflection rollers for forming the sheet stacking region have a diameter that is less than a diameter of other rollers of the sheet extraction device.

17. A sheet depositing arrangement for depositing sheets in sheet stacks, the sheet depositing arrangement comprising:

at least one sheet depositing apparatus comprising:

a sheet stacking chamber for creating a sheet stack from the sheets;

a sheet extraction device having a sheet transporting means that is drivable in a direction of circulation, a sheet delivery region for delivering the sheets to be stacked to the sheet stacking chamber by way of the sheet transporting means, a sheet stacking region, provided downstream of the sheet delivery region with regard to the direction of circulation, for stacking the sheets to be stacked into the sheet stacking chamber, with the sheet stack being formed, by way of the sheet transporting means, wherein the sheet transporting means extends in a straight line at least regionally directly adjacent to the sheet stacking chamber in the sheet stacking region, and the sheet extraction device further comprising a return region, provided downstream of the sheet stacking region with regard to the direction of circulation, for the sheet transporting means; and a sheet retaining device with at least one sheet retaining element, arranged adjacent to the sheet stacking region, for preventing at least one sheet to be stacked from being drawn into the sheet extraction device from the sheet stacking chamber by the sheet transporting means, the at least one sheet retaining element having at least one free head end which faces upstream with regard to the direction of circulation and being arranged adjacent to the sheet stacking region, wherein the at least one sheet retaining element narrows towards the at least one free head end, wherein the at least one sheet retaining element extends at least regionally along the sheet stacking region.

18. A sheet depositing arrangement for depositing sheets in sheet stacks, the sheet depositing arrangement comprising:

at least one sheet depositing apparatus comprising:

a sheet stacking chamber for creating a sheet stack from the sheets;

a sheet extraction device having a sheet transporting means that is drivable in a direction of circulation, a sheet delivery region for delivering the sheets to be stacked to the sheet stacking chamber by way of the sheet transporting means, a sheet stacking region, provided downstream of the sheet delivery region with regard to the direction of circulation, for stacking the sheets to be stacked into the sheet stacking chamber, with the sheet stack being formed, by way of the sheet transporting means, wherein the sheet transporting means extends in a straight line at least regionally directly adjacent to the sheet stacking chamber in the sheet stacking region, and the sheet extraction device further comprising a return region, provided downstream of the sheet stacking region with regard to the direction of circulation, for the sheet transporting means; and a sheet retaining device with at least one sheet retaining element, arranged adjacent to the sheet stacking region, for preventing at least one sheet to be stacked from being drawn into the sheet extraction device from the sheet stacking chamber by the sheet transporting means, the sheet transporting means having at least one outwardly open receiving recess for at least partially receiving the at least one sheet retaining element, wherein the at least one sheet retaining element extends at least regionally along the sheet stacking region, wherein deflection rollers for forming the sheet stacking region have a diameter that is less than a diameter of other rollers of the sheet extraction device.

* * * * *